US009556531B2

(12) United States Patent
Erdemir et al.

(10) Patent No.: US 9,556,531 B2
(45) Date of Patent: Jan. 31, 2017

(54) METHOD FOR ULTRA-FAST BORIDING

(71) Applicant: UChicago Argonne LLC, Chicago, IL (US)

(72) Inventors: Ali Erdemir, Naperville, IL (US); Vivekanand Sista, Willowbrook, IL (US); Ozgenur Kahvecioglu, Istanbul (TR); Osman Levent Eryilmaz, Plainfield, IL (US)

(73) Assignee: UChicago Argonne, LLC, Chicago, IL (US)

( * ) Notice: Subject to any disclaimer, the term of this patent is extended or adjusted under 35 U.S.C. 154(b) by 275 days.

(21) Appl. No.: 14/158,181

(22) Filed: Jan. 17, 2014

(65) Prior Publication Data

US 2015/0203980 A1 Jul. 23, 2015

(51) Int. Cl.

| | |
|---|---|
| ***C23C 8/68*** | (2006.01) |
| ***C25D 11/02*** | (2006.01) |
| ***C25D 3/66*** | (2006.01) |
| *C25D 3/56* | (2006.01) |

(52) U.S. Cl.

CPC ..... *C25D 11/028* (2013.01); *C25D 3/66* (2013.01)

(58) Field of Classification Search

CPC ..... C23D 3/56; C23D 3/66; C23D 11/028; C23C 4/10; C23C 14/067; C23C 16/30; C23C 16/38; C23C 20/08; C23C 28/34

See application file for complete search history.

(56) References Cited

U.S. PATENT DOCUMENTS

| | | | | |
|---|---|---|---|---|
| 2010/0018611 | A1* | 1/2010 | Timur | C23C 8/42 148/241 |
| 2010/0224498 | A1* | 9/2010 | Urgen | C23C 8/02 205/91 |
| 2015/0060051 | A1* | 3/2015 | Sista | C25D 11/028 166/242.4 |

* cited by examiner

*Primary Examiner* — Lois Zheng
(74) *Attorney, Agent, or Firm* — Foley & Lardner LLP

(57) ABSTRACT

An article of manufacture and method of forming a borided material. An electrochemical cell is used to process a substrate to deposit a plurality of borided layers on the substrate. The plurality of layers are co-deposited such that a refractory metal boride layer is disposed on a substrate and a rare earth metal boride conforming layer is disposed on the refractory metal boride layer.

4 Claims, 28 Drawing Sheets

O. Ozdemir et al. / Vacuum 80 (2006) 1391–1395

Pack Boriding

Electrochemical Boriding

Very fast

Hardness values of the borided WC-Ni6% alloy at 50g load.
Boriding Conditions:- 1030° C, 500mA/cm², 1h

METHOD FOR ULTRA-FAST BORIDING

STATEMENT OF GOVERNMENT INTEREST

The U.S. Government has rights in the invention pursuant to Contract No. W-31-109-ENG-38 between the U.S. Government and the University of Chicago and/or pursuant to DE-AC-02-06 CHJ11357 between the U.S. Government and UChicago Argonne, LLC representing Argonne National Laboratory.

FIELD OF THE INVENTION

This invention relates to article and methods for manufacture for producing a borided materials by using an ultra-fast methodology. More particularly the invention relates to a method for ultra-fast manufacturing of borided metal-cutting and metal-forming tools to increase their operating lifetime, as well as provide improved performance. Further, the invention relates to the ultra-fast boriding of cemented carbide based tool components, such as WC, W-alloys and high carbon, high alloy steels use in metal cutting and metal forming tools.

BACKGROUND OF THE INVENTION

Most mechanical components used in a variety of rolling, rotating, or sliding bearing applications, as well as those that are used in metal-cutting and -forming operations, rely strongly on high hardness and low friction surface properties of base metals for high performance and durability during actual uses. There are numerous surface treatment methods that are currently used to enhance the near-surface properties of engineering components. Some of these methods (such as nitriding, carburizing, carbonitriding, boriding) are thermochemical in nature and based on thermal diffusion of carbon, nitrogen, and boron atoms into the near surface regions of these components at high temperatures. It typically takes about 8 to 10 hours to achieve case depths of 50 to 100 micrometers in the cases of nitriding and carburizing processes; and as for boriding, the case depths are much shallower (typically 10 to 15 micrometer for the same processing time). Despite its ability to produce much harder surface layers than carburizing and nitriding, boriding is not used as extensively as the other surface treatment techniques mentioned.

There are several other surface treatment methods based on the uses of laser beams such as laser shot-peening, -glazing, -cladding, as well as ion and electron beam processes such as ion-beam deposition, electron-beam cladding, and hardening that can also be used to achieve superior surface mechanical and tribological properties. Besides these methods, there are plasma-based physical and chemical vapor deposition techniques that can also produce very hard surface coatings (such as TiN, TiC, etc.) on mechanical components for improved mechanical and tribological properties. Unfortunately, all of these methods require very long processing times and consume large amounts of energy.

Among the many thermal diffusion-based surface treatment processes mentioned above, nitriding and carburizing are used very extensively by industry to achieve greater mechanical and tribological properties on all kinds of steel components. In the case of boriding though, progress has been rather slow and at the moment, this technique has very limited uses. Just like nitriding and carburizing, boriding is a surface hardening process in which boron atoms diffuse into the near surface region of a work piece and react with the metallic constituents to form hard borides. A deep diffusion layer also exists beneath the boride layers. At present, there are several kinds of boriding methods available (such as salt-bath boriding, fluidized bed boriding, pack boriding, paste boriding, gas-phase and plasma boriding) for the production of borided surface layers. These methods are based on the uses of a variety of boron-rich solid, liquid, or gaseous media. Fluidized bed-, pack-, and paste-boriding methods use solid boron containing powders (such as $B_4C$, amorphous boron, ferro-boron, etc.) and other compounds during the boriding process, while plasma boriding uses gaseous boron compounds in a plasma environment.

All of the boriding methods mentioned above involve a high processing temperature (typically ranging from 700 to 1000° C.). These boriding methods are most appropriate for the treatment of ferrous alloys, but nonferrous and cermet-based materials can also be treated. For example, salt-bath boriding of steel substrates can be done in a complex salt bath typically consisting of 60 to 70 wt % borax, 10 to 15 wt % boric acid, and 10-20 wt % ferro-silicon or -boron at temperatures ranging from 800 to 1000° C. 5 to 7 h of boriding of a low carbon steel substrate in such a salt-bath may result in 7 to 10 micrometer thick borided surface layers.

During boriding of steel and other metallic and alloy surfaces, boron atoms diffuse into the material and form various types of metal borides. In the case of ferrous alloys, most prominent borides are: $Fe_2B$ and FeB. Some of the boron atoms may dissolve in the structure interstitially without triggering any chemical reaction that can lead to boride formation. Iron borides (i.e., $Fe_2B$ and FeB) are chemically very stable and mechanically hard and hence can substantially increase the resistant of base alloys to corrosion, adhesive, erosive, or abrasive wear. Process conditions (such as duration of boriding, ambient temperature, type of substrate material and boriding media) may affect the chemistry and thickness of the borided surface layers. Due to the much harder nature of borided layers, boriding has the potential to replace some of the other surface treatment methods like carburizing, nitriding and nitrocarburizing.

Boride layers may achieve hardness values of more than 20 GPa depending on the chemical nature of the base materials. $TiB_2$ that forms on the surface of borided titanium substrates may achieve hardness values as high as 30 GPa; while the hardness of boride layers forming on steel or iron-based alloys may vary between 14 GPa to 18 GPa. Such high hardness values provided by the boride layers are retained up to 650° C. Since there is no discrete or sharp interface between the boride layer and base material, adhesion strengths of boride layers to base metals are excellent. With the traditional methods mentioned above, boride layer thicknesses of up to 20 micrometer can be achieved after long periods of boriding time at much elevated temperatures. In addition to their excellent resistance to abrasive and adhesive wear, the boride layers can also resist oxidation and corrosion even at fairly elevated temperatures and in highly acidic or saline aqueous media.

Materials that are most suitable for boriding include all types of ferrous metals and alloys like low- and high-carbon steels, low- and high-alloy steels, tool steel, stainless steels, carburized, nitrided, and carbonitrided steels, and cast irons. Non ferrous metals and their alloys like titanium, tantalum, zirconium, tungsten, niobium, molybdenum, magnesium, most nickel-based and cobalt-based superalloys, cobalt-chrome alloys, tungsten and sintered carbides and/or cements can also be borided.

Because of their very impressive mechanical, tribological, chemical and corrosion properties, borided surface layers can be used in a large variety of industrial applications. In metal-forming dies, they can be used to protect the critical surface finish or profiles of all kinds of dies (such as punching dies, drawing dies, bending dies, hot forming, and injection moulding dies, forging dies, extrusion dies, embossing dies, deep drawing and impact extrusion dies). They can also be used in insertion pins, rods, plungers, bushings, botts, nozzles, pipe bending devices, guide rings, sleeves, mandrels, swirl elements, clamping, chucks, guide box, metal casting inserts, orifices, springs, balls, rollers, discs, valve components and fittings, plugs, chain components, etc. They will be extremely well-suited for stainless steel and other metallic-based mechanical shaft seals used in pumping all kinds of fluids in chemical industries. In the automotive or transportation fields, they can prevent seizure, galling and scuffing-related failures under severe operating conditions, and eliminate oxidative and corrosive degradation of a large variety of engine components. They can also be used in a variety of gear drives (such as bevel gears, screw and wheel gears, helical gear wheels), including gears, bearings, tappets, valves and valve guides, power train components, piston pins, rings and liners, and other mechanical components in all classes of moving mechanical systems that experience heavy loading, high speeds, erosive, corrosive, and oxidative media and elevated temperatures. Other potential applications include cold and hot forging tools, extrusion tools, press tools, glass industry tools, invasive and implantable medical devices such as hip and knee joints made out of titanium, zirconium, cobolt-chrome, and other specialty metals and their alloys. Because of the very high boron content of their near surfaces, borided surfaces can also provide an excellent substrate for the deposition of diamond and diamondlike carbon films on metallic substrates. In most cases, diamond is very difficult to deposit on steel substrates; but after the boriding process such surfaces could be very ideal for the nucleation and growth of crystalline diamond and amorphous diamondlike carbon films.

Despite their abilities to produce much harder surface layers and superior components over other methods, boriding methods mentioned above are not used very extensively by industry at the moment. There are substantial problems that hinder their wider uses. Some of these problems include: high-cost, very long processing time, toxic emissions/byproducts, and poor surface condition or finish after the boriding process. For all of these reasons, it would be very desirable to develop a new and improved boriding method that is very fast, cheap, safe, and applicable to a wide range of materials.

SUMMARY OF THE INVENTION

Ultra-fast boriding of metal-cutting and forming tools is provided to increase commercial production rate as well as improve tool and/and part operating lifetime and performance. In particular, the invention is directed toward the boriding of cemented carbide based tool inserts like tungsten carbide (WC), W-alloys, and high-carbon, high-alloy steels, such as, high speed and D2 quality steels that are used in the manufacture of metal-cutting and forming tools. Ultra-fast boriding process produces very hard and thick layers on these materials and makes their surfaces very resistant to wear, oxidation and corrosion. Such treated tools and parts have much improved operating lifetime and performance. Boriding of WC inserts can potentially minimize or eliminate necessity of physical vapor deposition (PVD), or chemical vapor deposition (CVD) coating of these inserts or can be complimentary to such coating processes to achieve improved combined performance if applied sequentially. Boriding of WC tools or parts will create a much harder (up to 3500 Vickers) tungsten boride layer on the surface of the treated material. Boride layers are also chemically very stable at high temperatures which can create additional benefits since cutting operations create very high temperatures in cutting wear of cutting tool as well.

The invention also relates to boriding of group IVB, VB or VIB metals, Re and Si, and their compounds to improve mechanical, chemical and tribological properties on the surface. In a preferred article, a plurality of separate, thin conformal layer of Re and W boride are produced to protect an underlying alloy substrate. These boriding materials are not limited in use, but primarily can be used in manufacturing industries for cutting and forming operations. Boriding tools can also be used in dry Al and Mg machining (which is very difficult with existing tool materials and coatings). In addition, boriding of WC—Ni6% and WC—Co6% can improve tribological performance of corrosion resistance of components that are commonly used in corrosive fluid handling (valves, nozzles, rotary seals and bearings), and other harsh chemical environments.

The ultra-fast boriding is most preferably done in an electrochemical cell using high-temperature salt baths that typically consist of borax and a range of inorganic sodium compounds. This process provides much faster and efficient boriding on different IVB, VB, VIB and VIIB group transition metals and their alloys. All of these metals and alloys are used extensively in metal-cutting and forming operations due to their much higher resistance to heat, corrosion, oxidation and wear.

The process can best be performed between about 900° and 1050° C. temperature, and the rate of boriding can vary with the temperature. Other important parameters that can influence the rate and quality of boriding are: bath composition, process duration, applied current density, anode-cathode distance, surface treatments before boriding process, roughness and cleanliness of the surface, cooling process after boriding and cleaning of electrolytes from the surface after boriding.

These and other advantages and features of the invention, together with the organization and manner of operation thereof, will become apparent form the following detailed description when taken in conjunction with the accompanying drawings described hereinbelow.

BRIEF DESCRIPTION OF THE DRAWINGS

FIG. 1(*b*) shows a pack boriding system (inset) and boride layer versus boriding time plot; and FIG. 1(*c*) shows an electrochemical boriding system (inset) and boriding layer versus boriding time plot;

FIG. 5(*b*) shows a plot of load (mN) versus penetration depth in nm for load application and unloading;

FIG. 6(*b*) illustrates a plot of load (mN) versus penetration depth in nm for load application and unloading;

FIG. 11(*b*) shows a cross section of the tested borided W—Re layer and surface; FIG. 11(*c*) shows a profilometer scan of the cross section of FIG. 11(*b*) and FIG. 11(*d*) shows a 3-D profilometer plot of the cross section of FIG. 11(*b*);

FIG. 13(*b*) shows a cross section of the tested borided W—Re surface; FIG. 13(*c*) shows a profilometer scan of the cross section of FIG. 13(B); and FIG. 13(*d*) shows a profilometer 3D image from the scan of FIG. 13(*c*).

DETAILED DESCRIPTION OF PREFERRED EMBODIMENTS

Figure 1A:
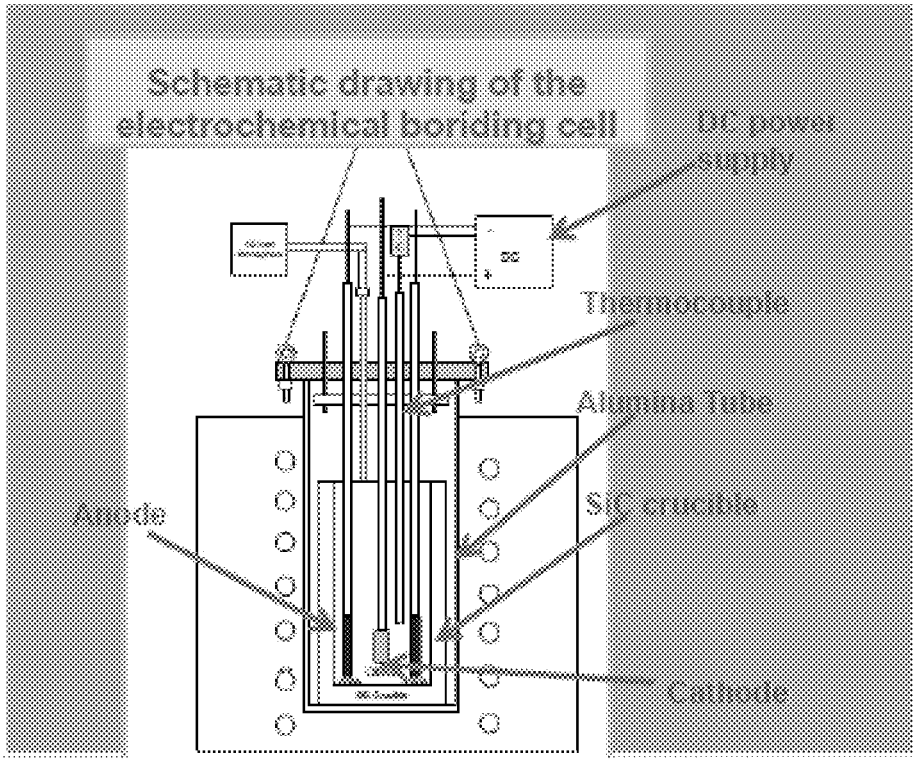
FIG. 1(*a*) illustrates a conventional molten electrolyte boriding system.
Figure 1B:
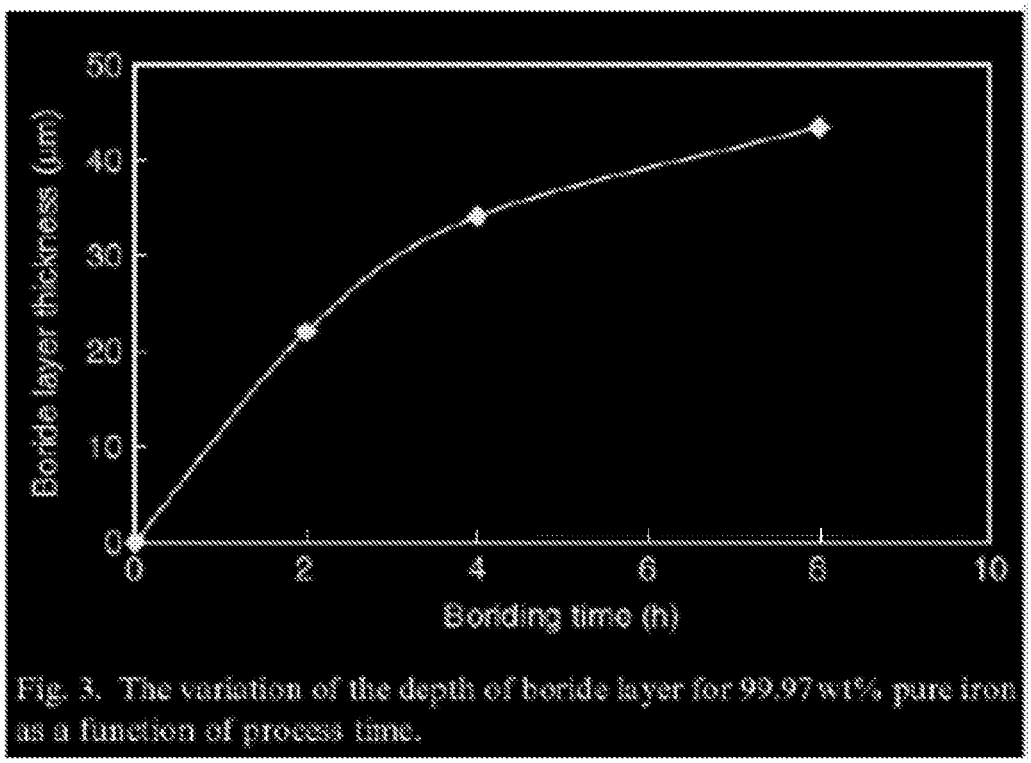
Figure 1C:
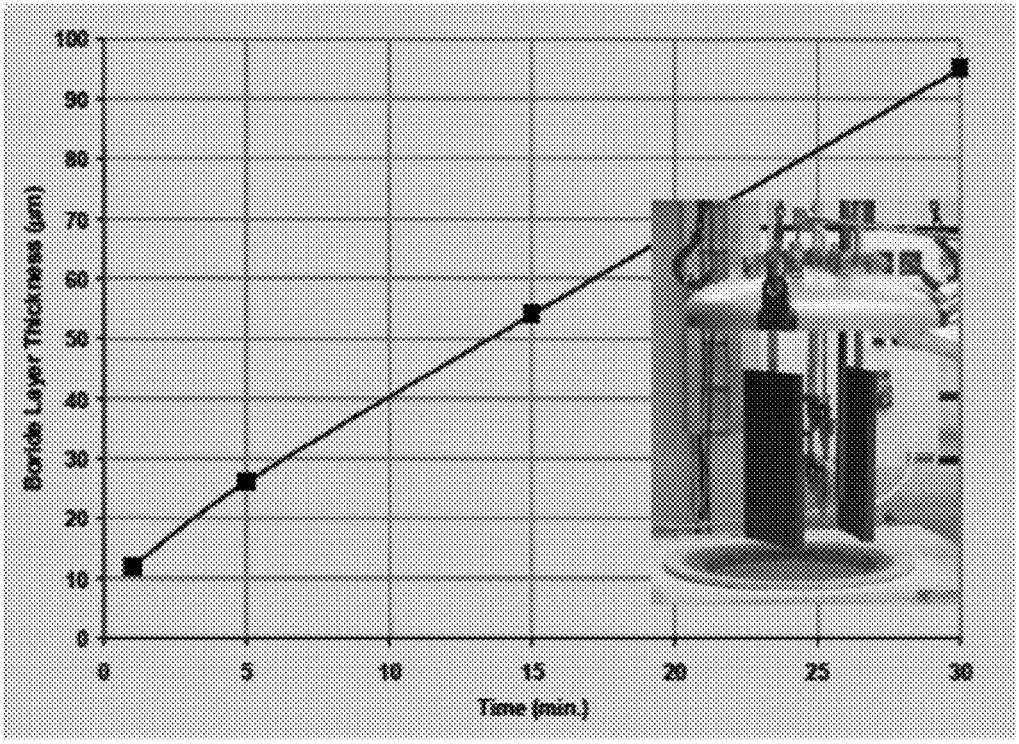
Figure 2:
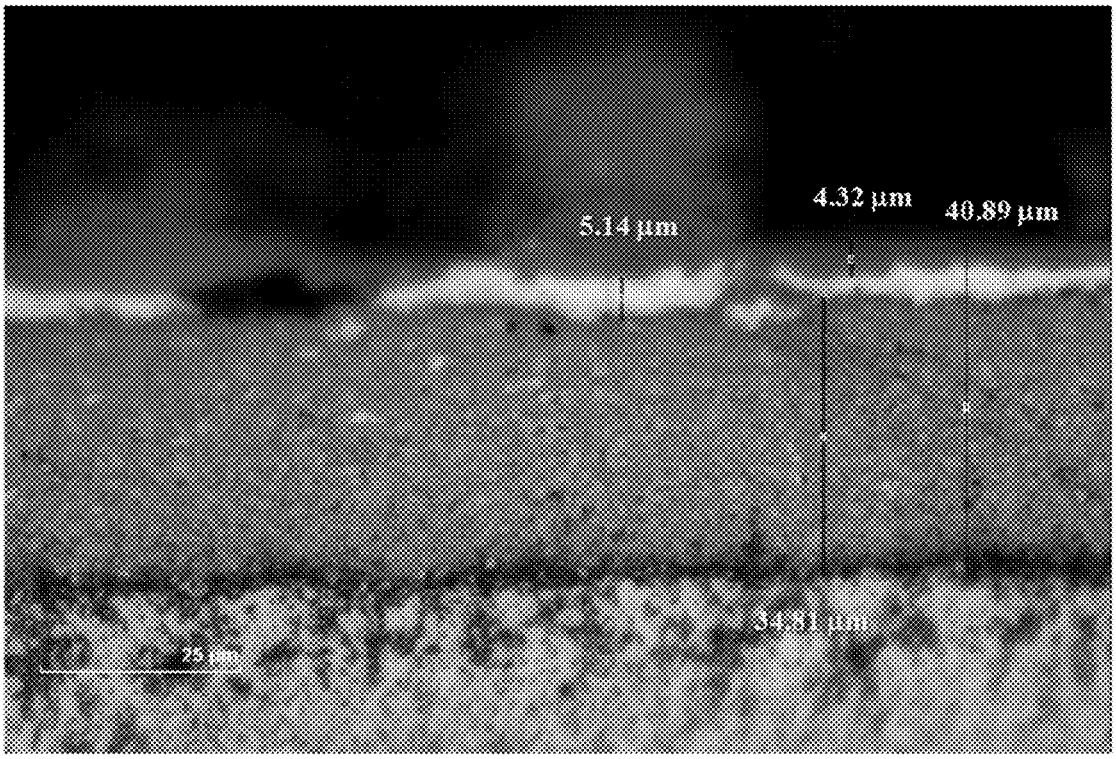
FIG. 2 is an optical micrograph of multiple boride layers on a tungsten (W) carbide substrate.

In FIGS. 1(*a*)-1(*c*) are shown various systems 10 and methods for performing boriding operations. In the preferred embodiment of the invention the system and method of FIG. 1(*c*) is utilized. In FIG. 2 is shows an optical micrograph of an article of manufacture having multiple boride layers 12, 14 and 16 disposed on a WC substrate 18. These layers 12, 14 and 16 are a combination of tungsten boride phases including $WB_4$, $W_2B_5$ and $WB_2$. Layer thicknesses can be varied by careful selection of electrolyte salt bath composition, and this process is preferably carried out at temperatures between about 900°-1050° C.

Figure 3:
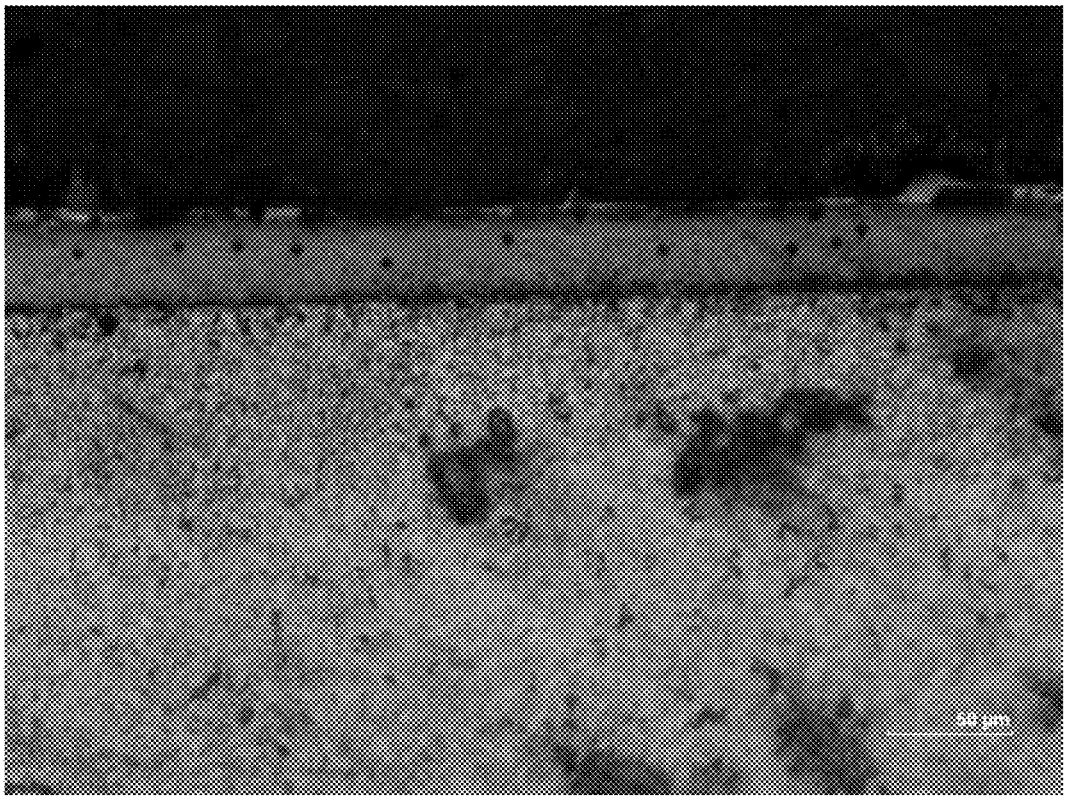
FIG. 3 illustrates hardness values for selected spots in an optical micrograph of WC—Ni6% alloy at 560 g load.
Figure 4:
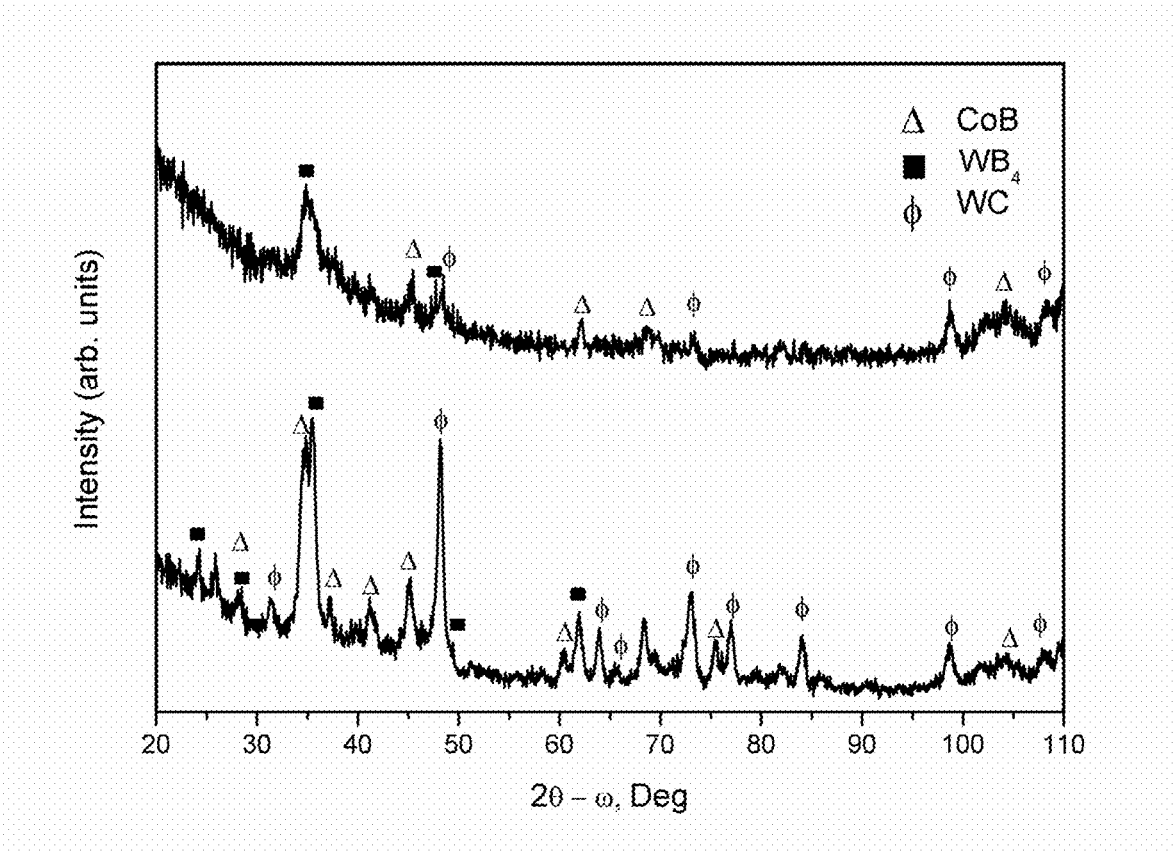
FIG. 4 illustrates an X-ray diffractometer scan of intensity versus 20–ω at a 1° glancing angle scan of a multi-layered boride for a WC—Co 6% substrate.

FIG. 3 is a micrograph of a cross section of a boriding WC—Ni6% alloy. Also shown are hardness values at selected locations, and the hardness values on these boriding tungsten carbide surfaces were in the range of about 31 GPa to 35 GPa. Preliminary results for the boriding of WC—Ni6% alloy showed excellent hardness values in the range of superhard materials. Further studies were conducted for the boriding of WC—Co6% alloy and X-ray diffraction pattern (both in regular 2θ−ω and 1° glancing angle modes) of the processed alloy is given in FIG. 4. The X-ray diffraction indicates that there are two possible phase formation after applying boriding process one of which is CoB phase and the other is $WB_4$ phase formation. Borided WC—Co6% alloys are found to have hardness values in the range of 11-12 GPa.

Figure 5A:
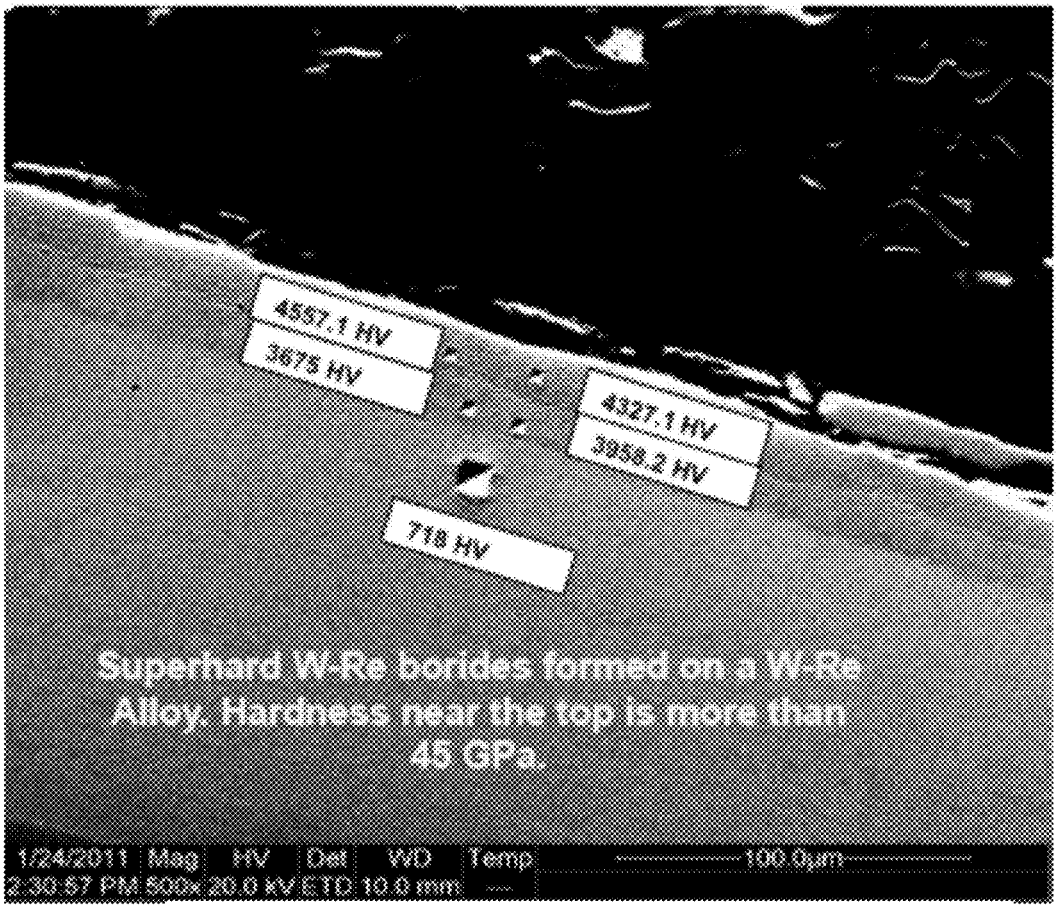
FIG. 5(*a*) is an SEM micrograph of separate $ReB_2$ and underlying $WB_4$ conformal layers on a W—Re alloy substrate with selected hardness values shown.
Figure 5B:
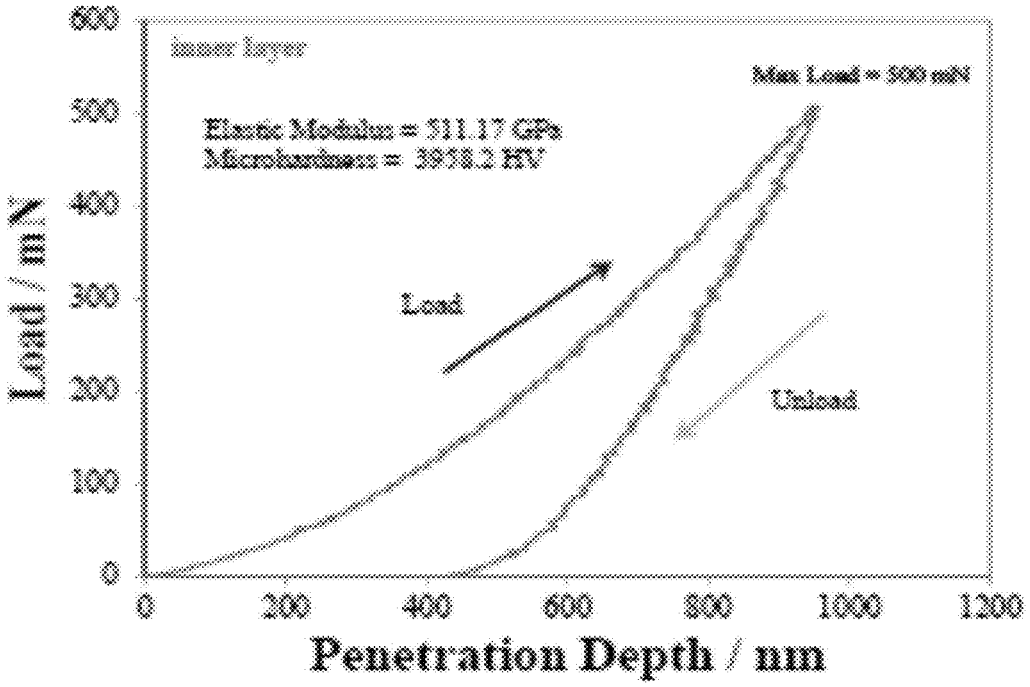
Figure 6A:
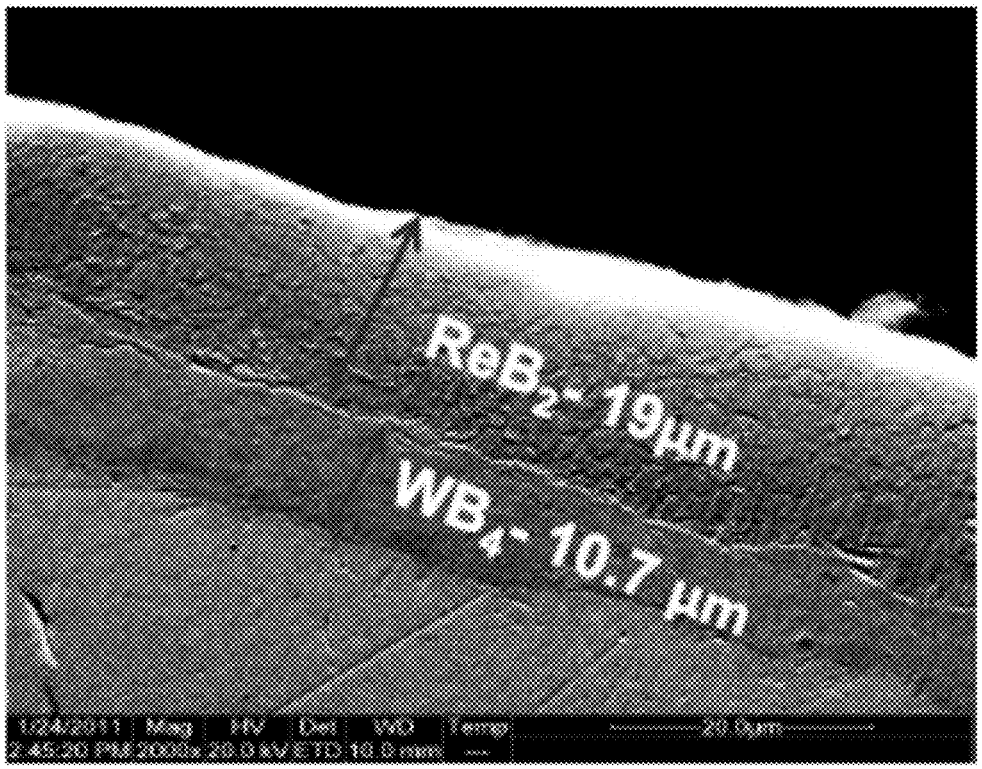
FIG. 6(*a*) is a higher magnification SEM micrograph of the alloy of FIG. 5(*a*) showing layer thicknesses for $ReB_2$ and $WB_4$ on the W—Re substrate.
Figure 6B:
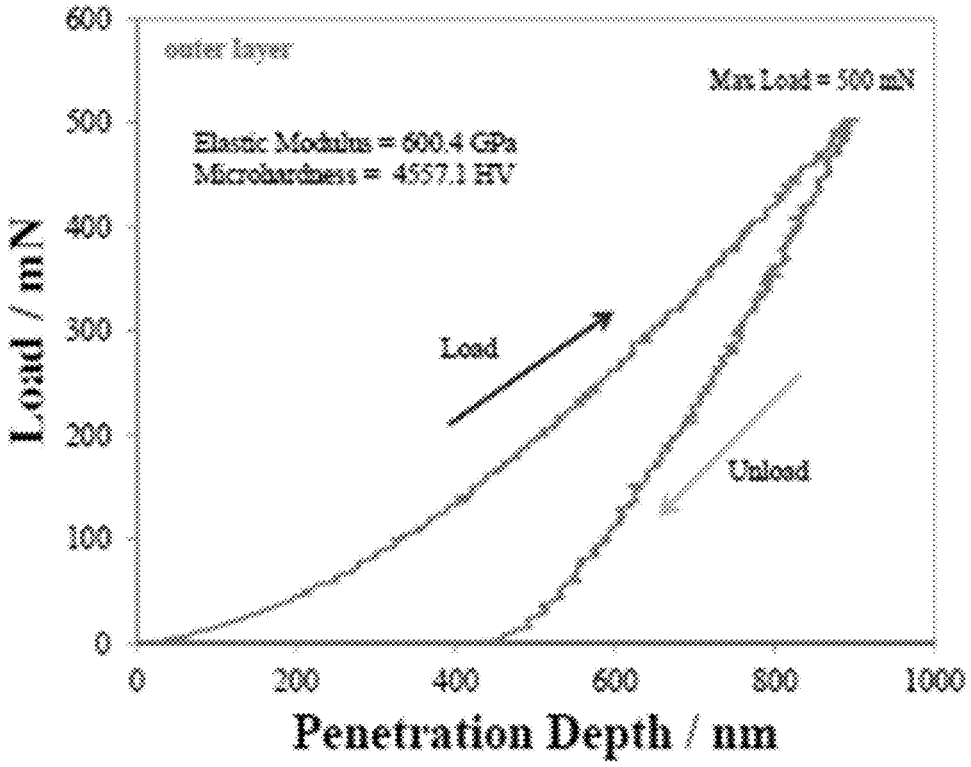

FIG. 5(*a*) shows superhard rhenium diboride and tungsten tetraboride phases disposed as separate layers obtained on the W—Re 25% alloy having a thickness of about 19 and 10.7 μm respectively. The formation of such superhard borides with very large thicknesses was achieved by a simple diffusion based conversion coating process which cannot be achieved by any deposition method (PVD or CVD). FIG. 5(*a*) also shows the hardness at selected locations of the superhard borides $ReB_2$ and $WB_4$ in the range of 36-46 GPa with 500 mN of load. FIGS. 5(*b*) and 6(*b*) show load/unload plots as the function of penetration depths of the inner $WB_4$ and the outer $ReB_2$ layer, respectively.

Boriding can also be done on all kinds of metallic and alloy surfaces including ferrous alloys, magnesium-base alloys, titanium base alloys, aluminum-based alloys, cobalt, cobalt and chromium based alloys, nickel, tantalum, zirconium, molybdenum, tungsten, niobium, hafnium, and rhenium. These borided metal and alloys can be used in various manufacturing and transportation applications such as metal forming tools, fuel injectors, gears, bearings and some of the power- and drive-train applications in cars and tracks.

Figure 7:
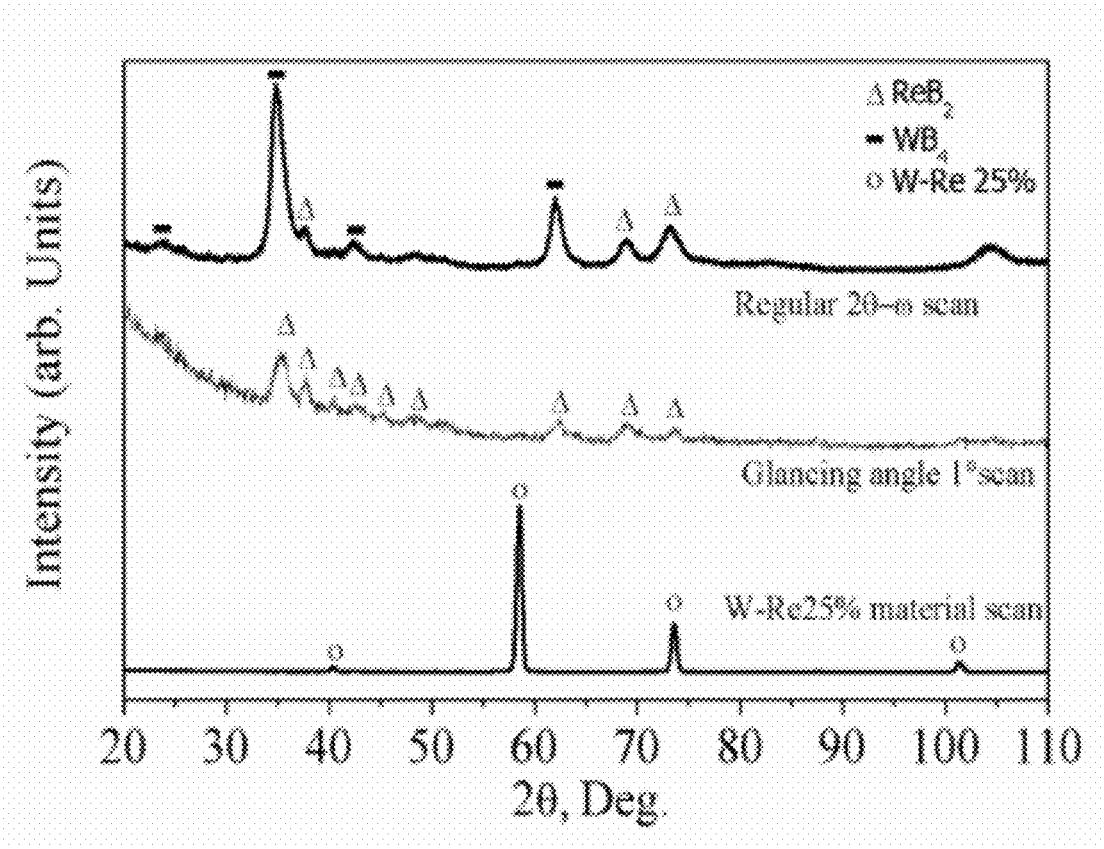
FIG. 7 shows an X-ray diffractogram of intensity versus scattering angle 2θ showing a mixture of $ReB_2$ and $WB_4$ layers with a top conformal layer of $ReB_2$ determined by glancing angle 1° scan and the inner conformal layer of $WB_4$ by a regular 2 θ−ω scan.

Further, FIGS. 5(*a*) and 6(*a*) show confirmation of the layered structure of the $ReB_2$ outer layer 2θ, underlying $WB_4$ layer 22 and the substrate 24 of W—Re alloy. The $ReB_2$ outer layer 2θ was determined by glancing angle 1° scans of 2θ−ω for an X-ray diffractometer (see FIG. 7). A regular 2θ−ω X-ray scan (see FIG. 7) was used to identify the underlying $WB_4$ layer 22 which also had some $ReB_2$ phase intermixed; and the substrate 24 was identified by a routine 2θ−ω X-ray scan.

Figure 8A:
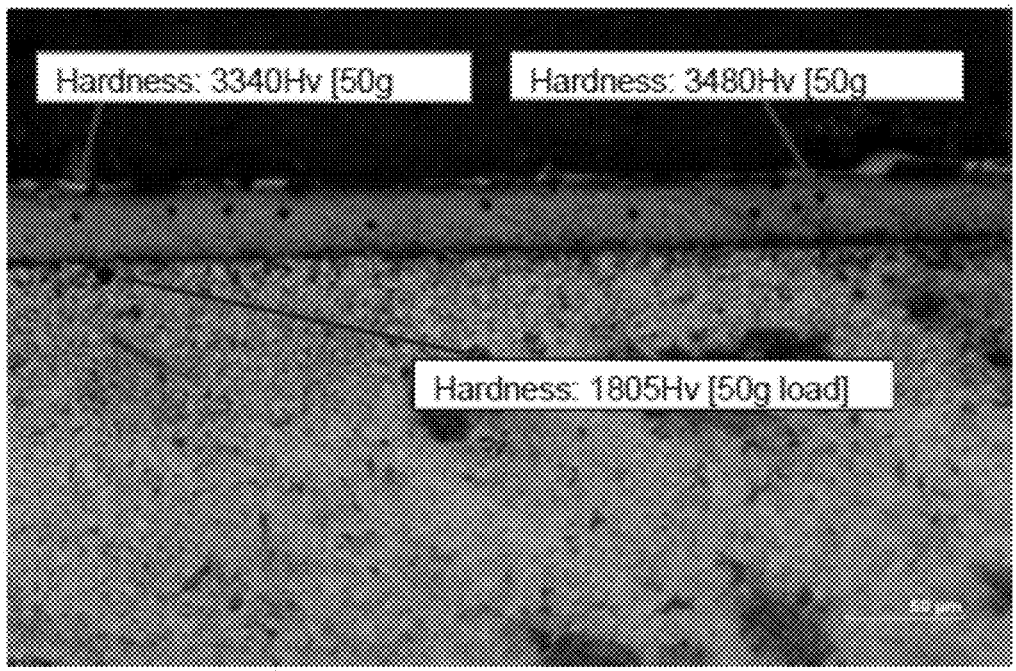
FIG. 8(*a*) shows a micrograph of a boriding WC surface with hardness values at selected positions and FIG. 8(*b*) shows hardness values in a micrograph of a borided WC—Ni 6% alloy at 50 g load.
Figure 8B:
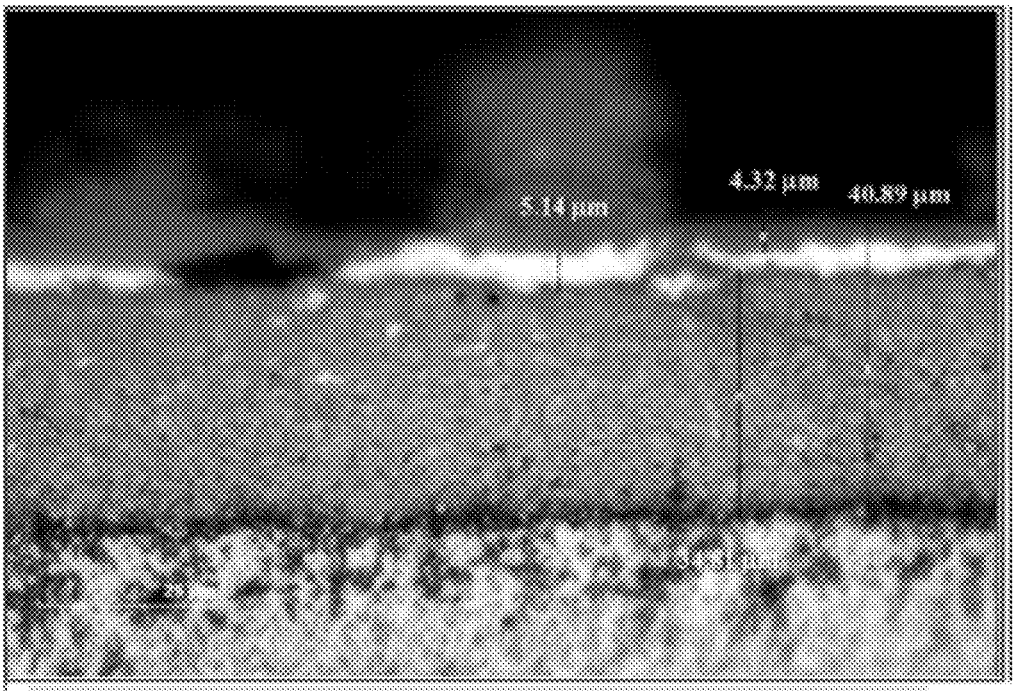

In yet another embodiment of the invention a borided WC—Ni6% alloy substrate was obtained by the method shows in FIG. 1(*c*). The micrograph of FIGS. 8(*a*) shows the hardness values at selected locations of the cross-section, and FIG. 8(*b*) shows the various layer thicknesses.

Figure 9:
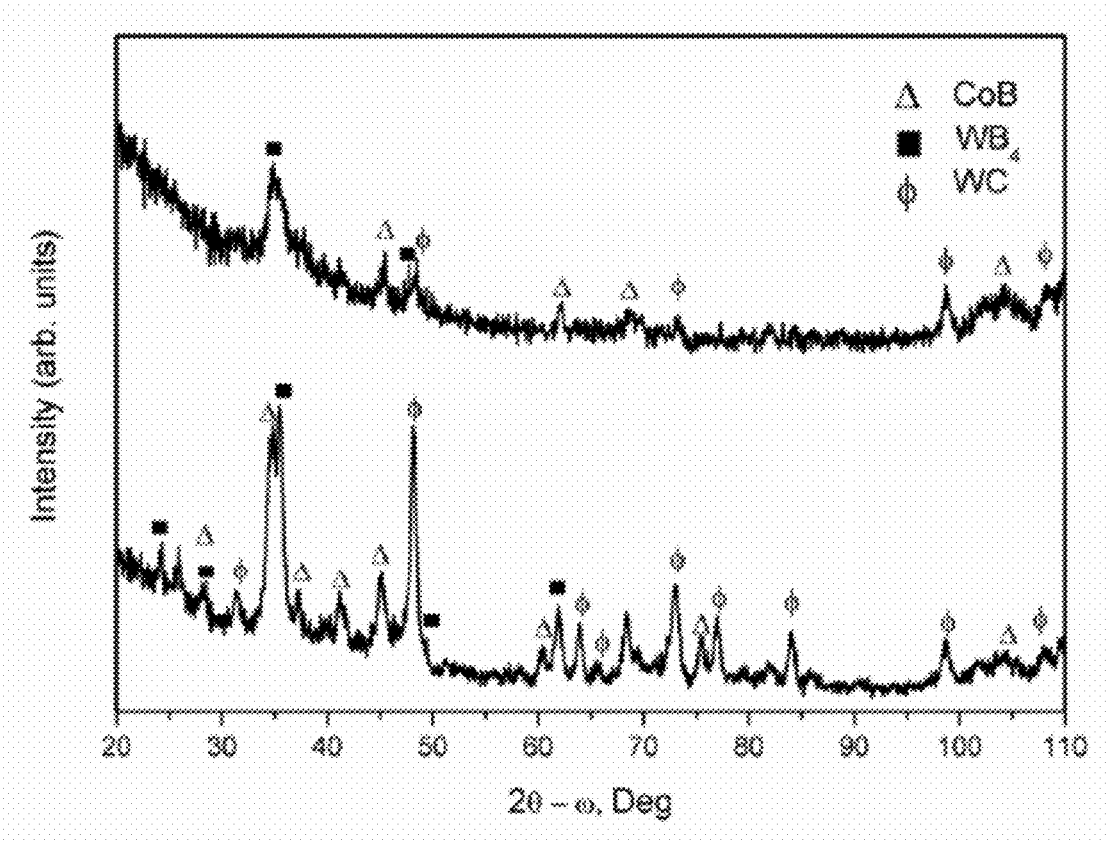
FIG. 9 shows X-ray diffractograms in intensity versus 2θ−ω with indicators at diffraction peaks characteristic of CoB, $WB_4$ and WC.
Figure 10A:
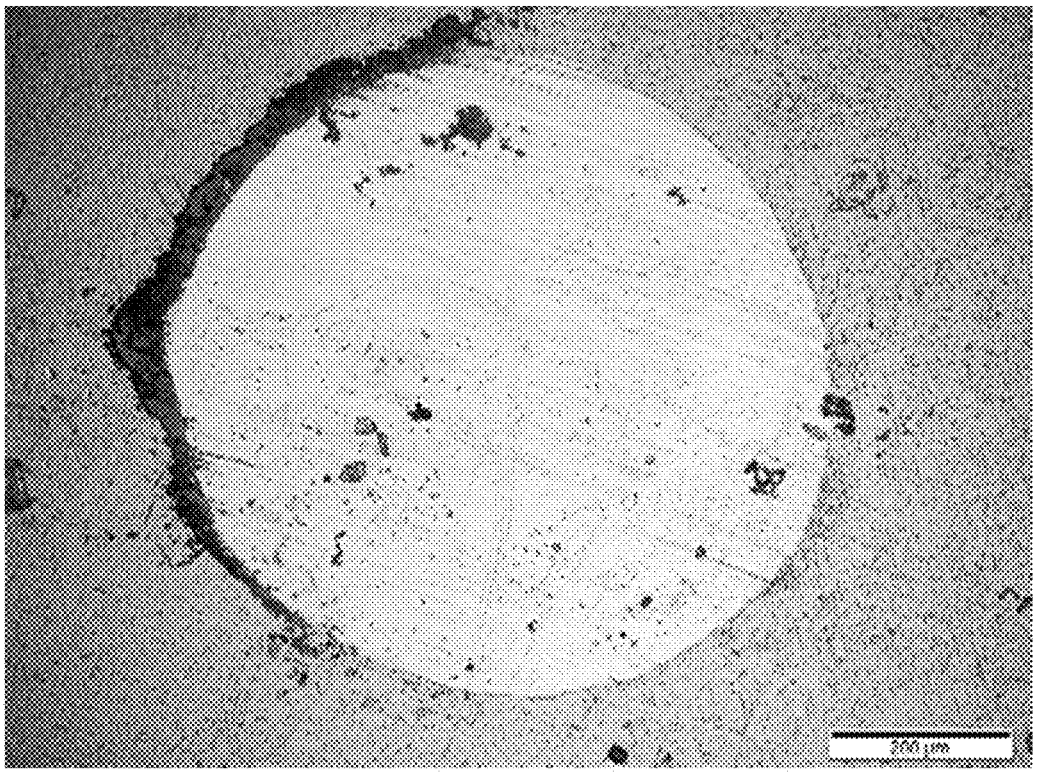
FIG. 10(*a*)-10(*c*) show micrographs of a borided W—Re alloy which has undergone wear testing against a fully hardened AISI 52100 grade steel ball and FIG. 10(*d*) shows coefficient of friction over time for testing of the borided W—Re alloy.
Figure 10B:
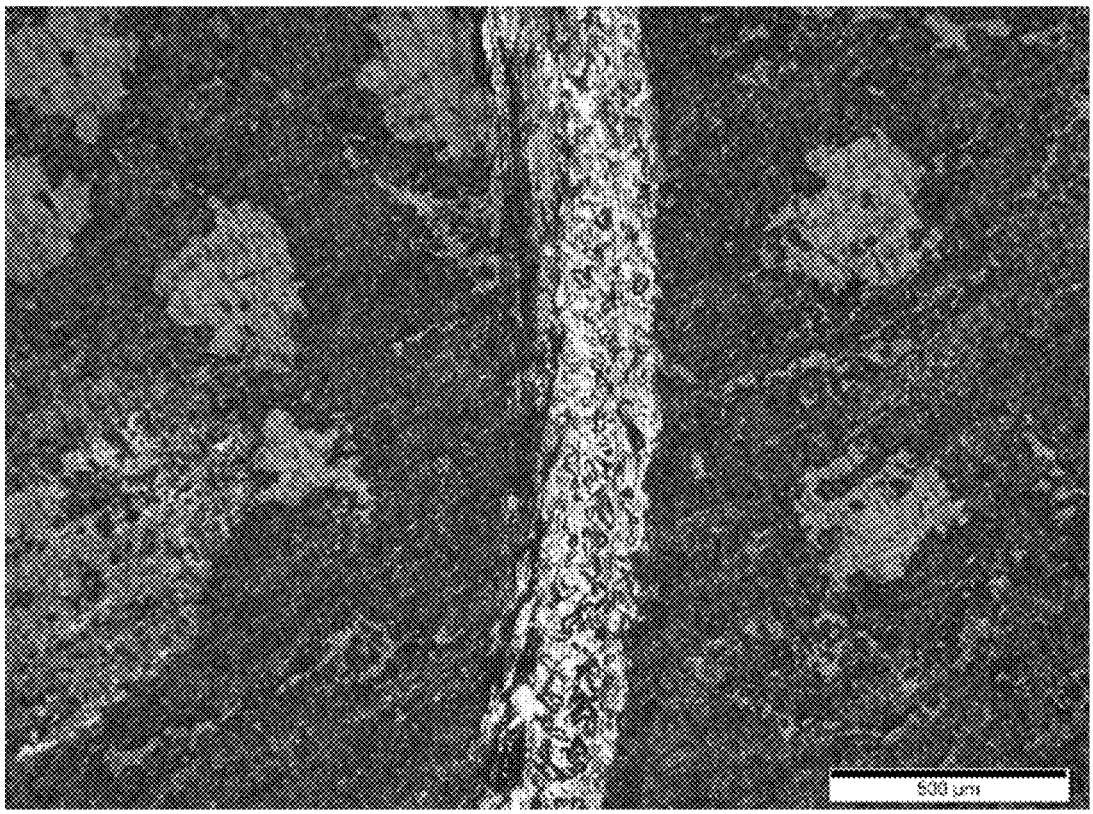
Figure 10C:
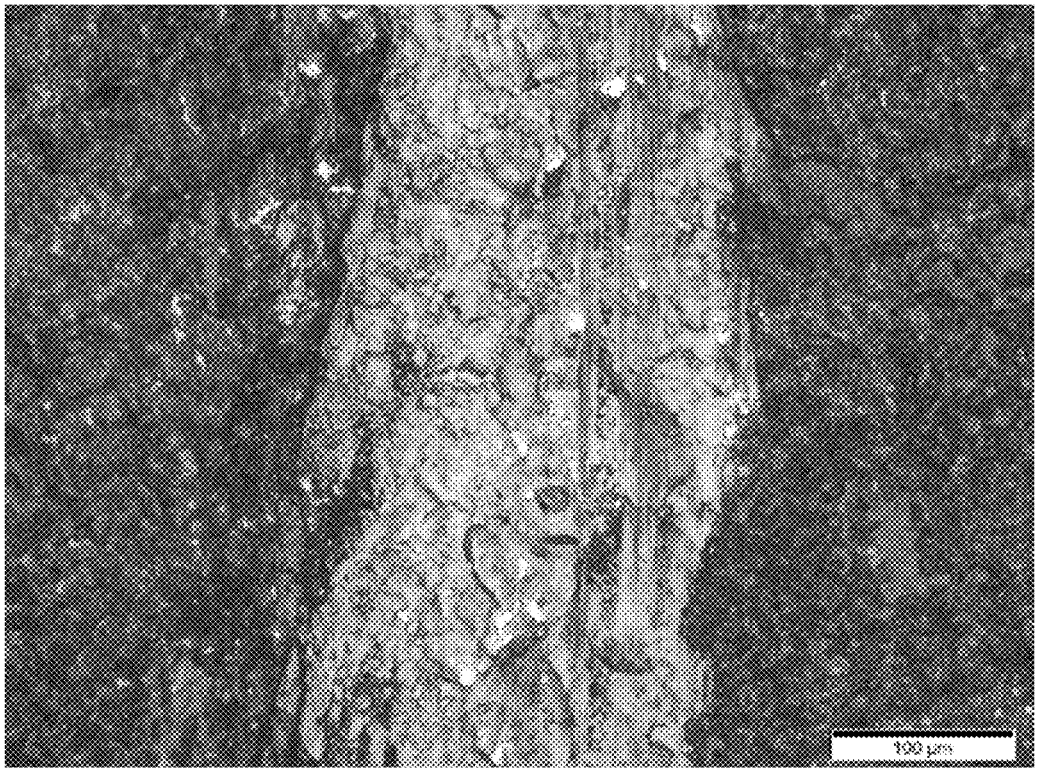
Figure 10D:
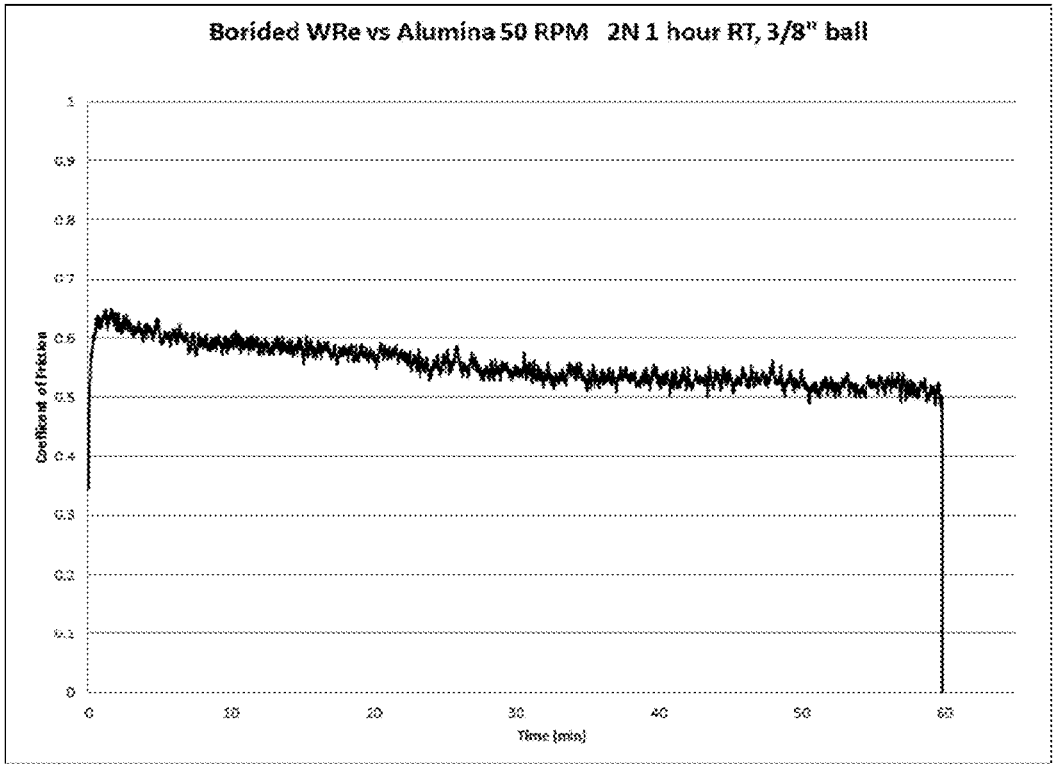
Figure 11A:
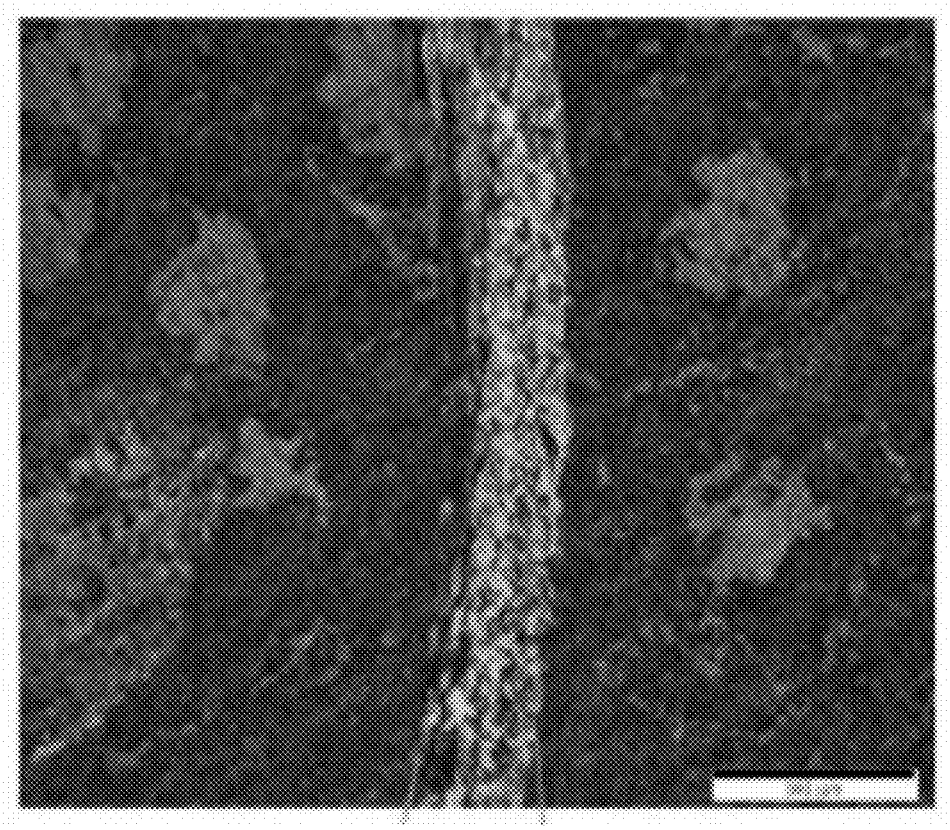
FIG. 11(*a*) shows an SEM image of the surface of a borided W—Re of FIGS. 10(*a*)-10(d)
Figure 11B:
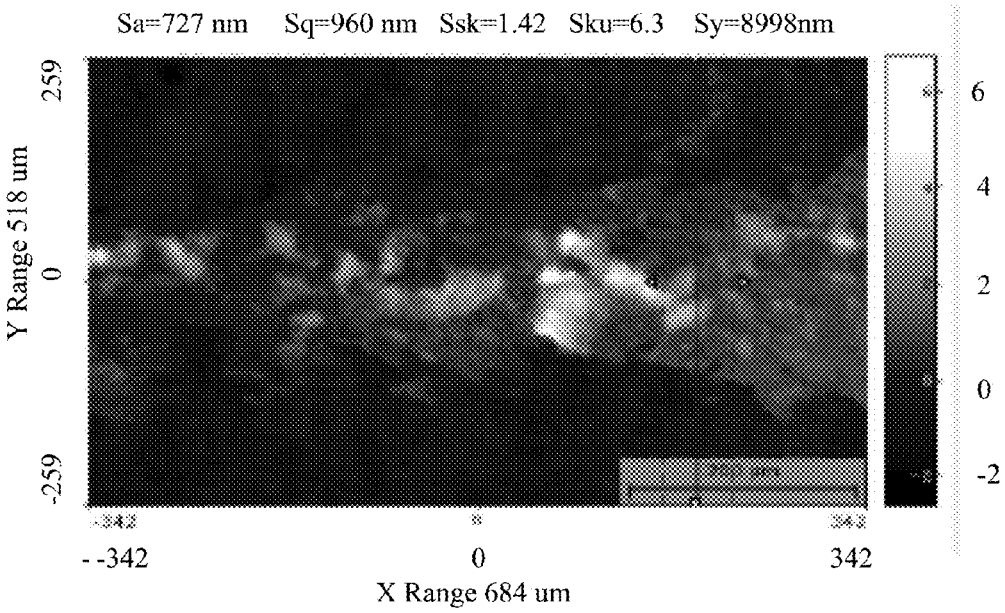
Figure 11C:
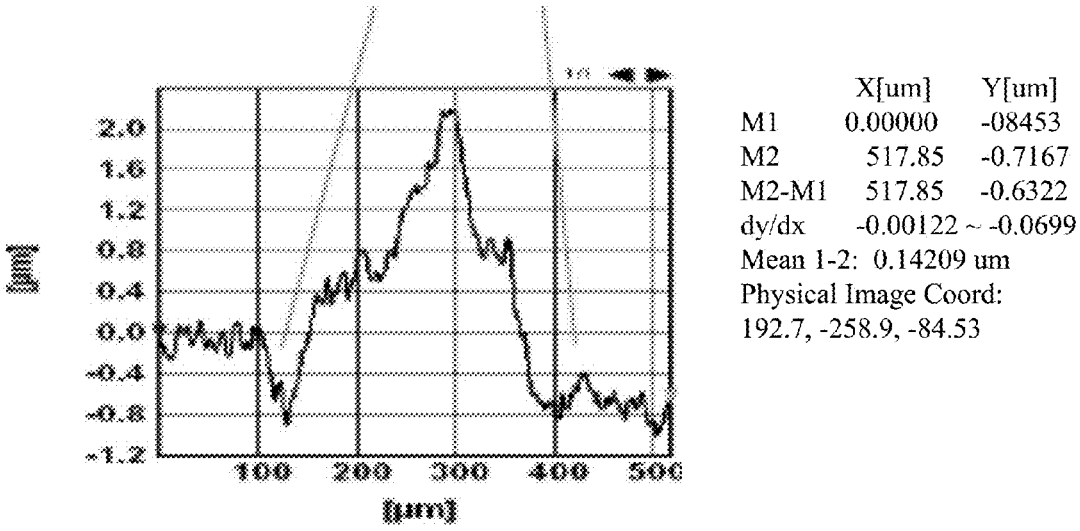
Figure 11D:
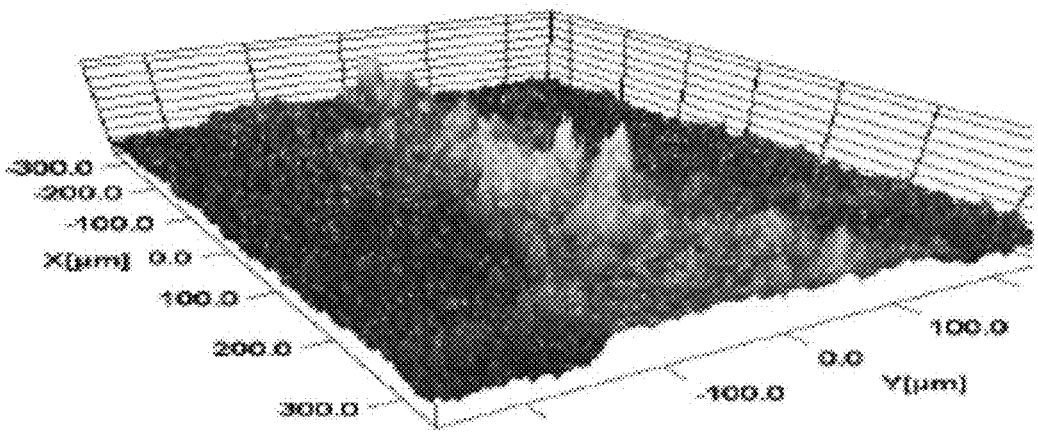
Figure 12A:
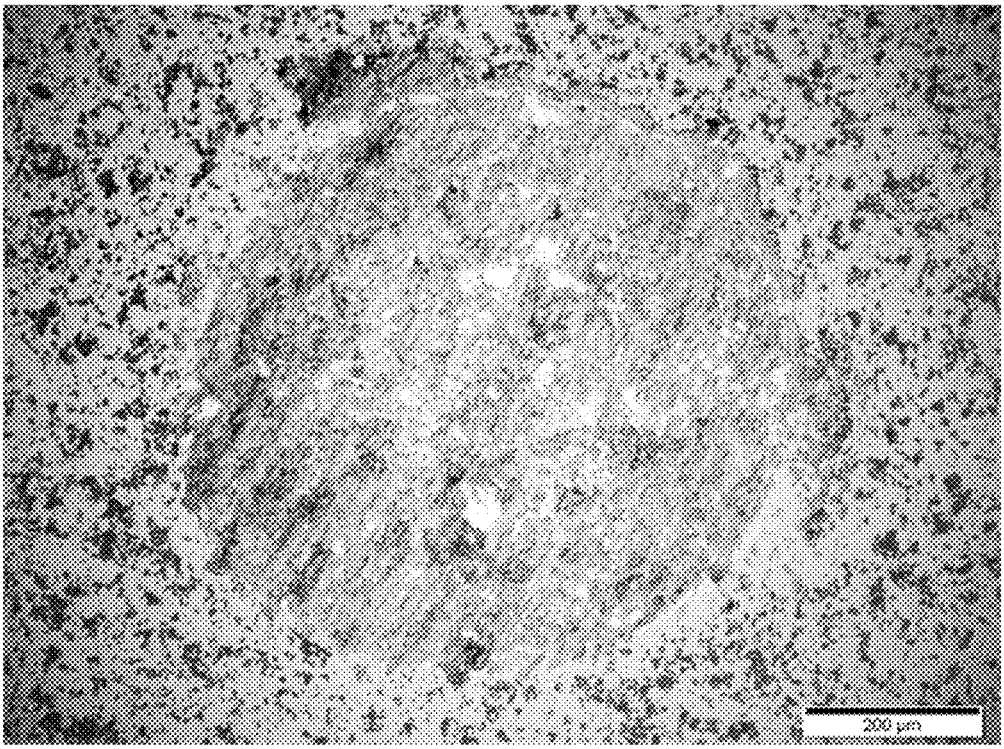
FIGS. 12(*a*)-(*c*) show micrographs of a borided W—Re alloy surface versus an alumina ball (⅜") at 50 rpm, at 2N load for 1 h at room temperature.
FIG. 12*d* shows a plot of coefficient of friction versus time for the wear test of FIGS. 12(*a*)-12(*c*)
Figure 12B:
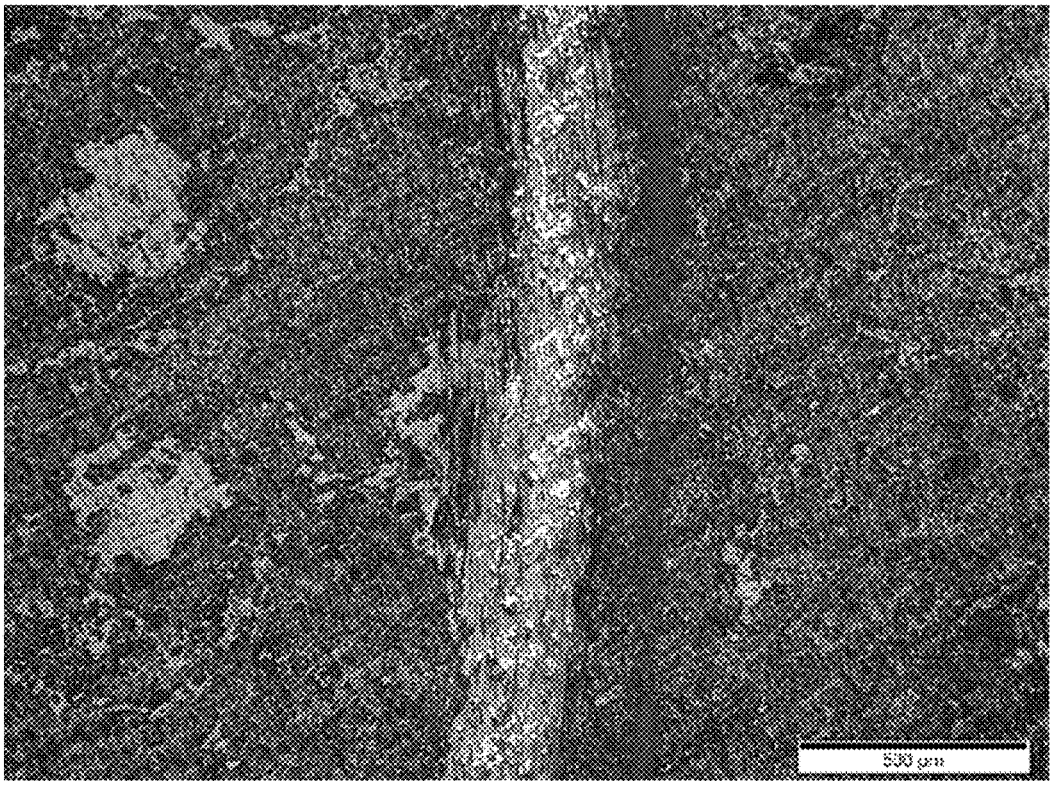
Figure 12C:
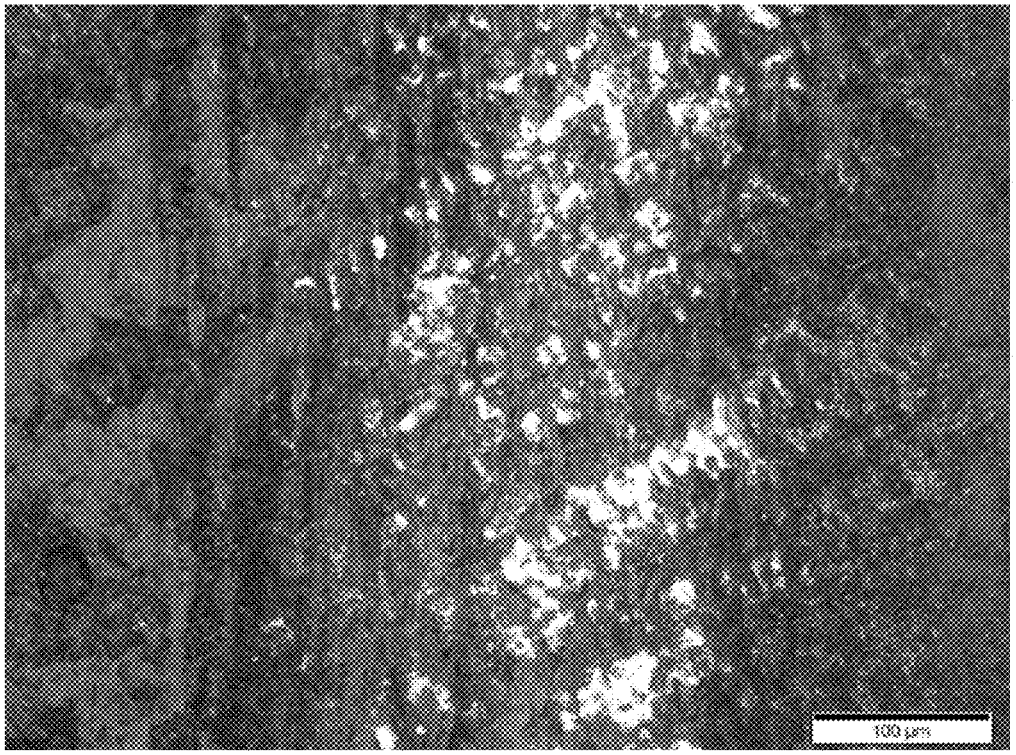
Figure 12D:
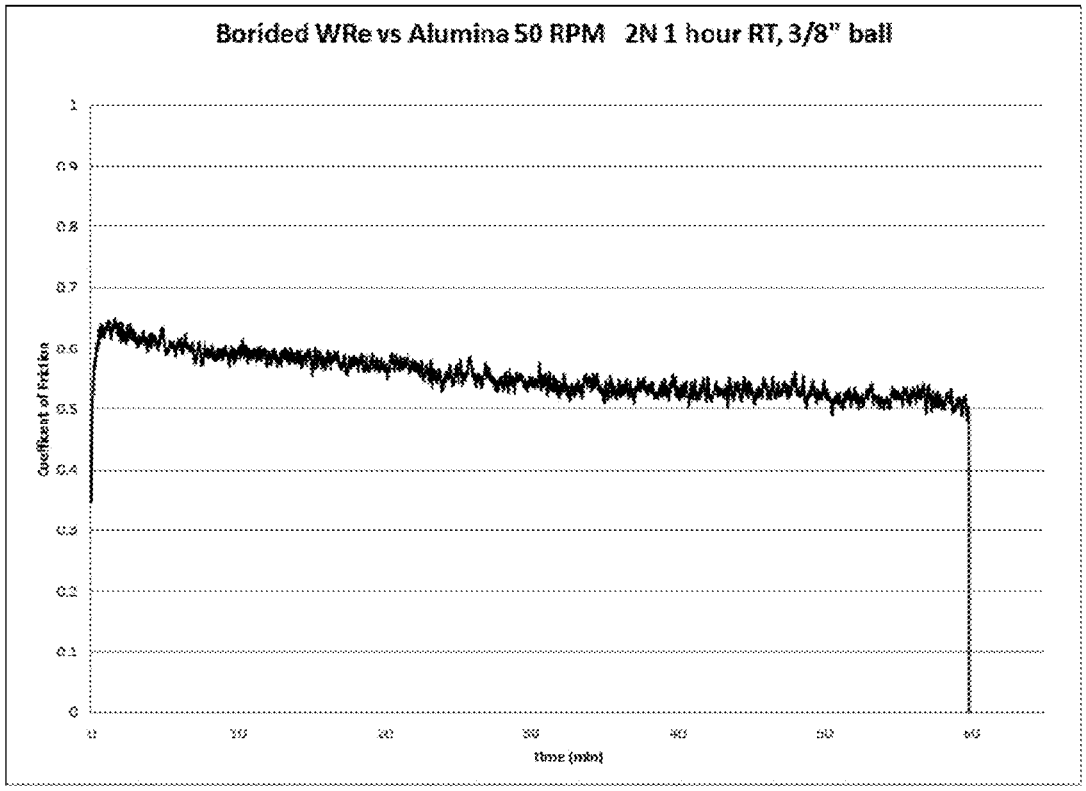
Figure 13A:
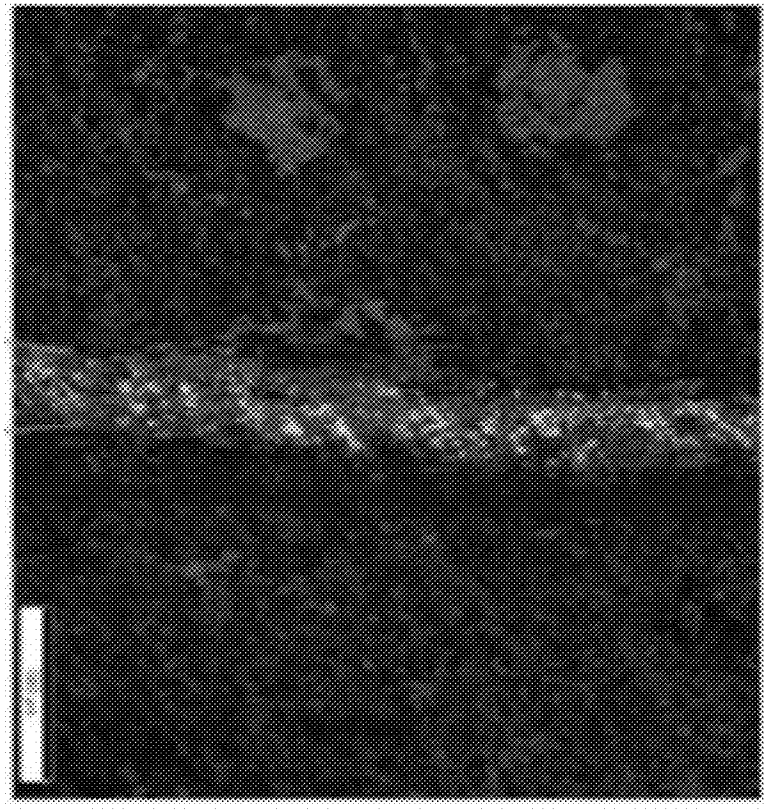
FIG. 13(*a*) shows an SEM image of the surface of a borided W—Re surface from the test of FIGS. 12(*a*)-12(*d*)
Figure 13B:
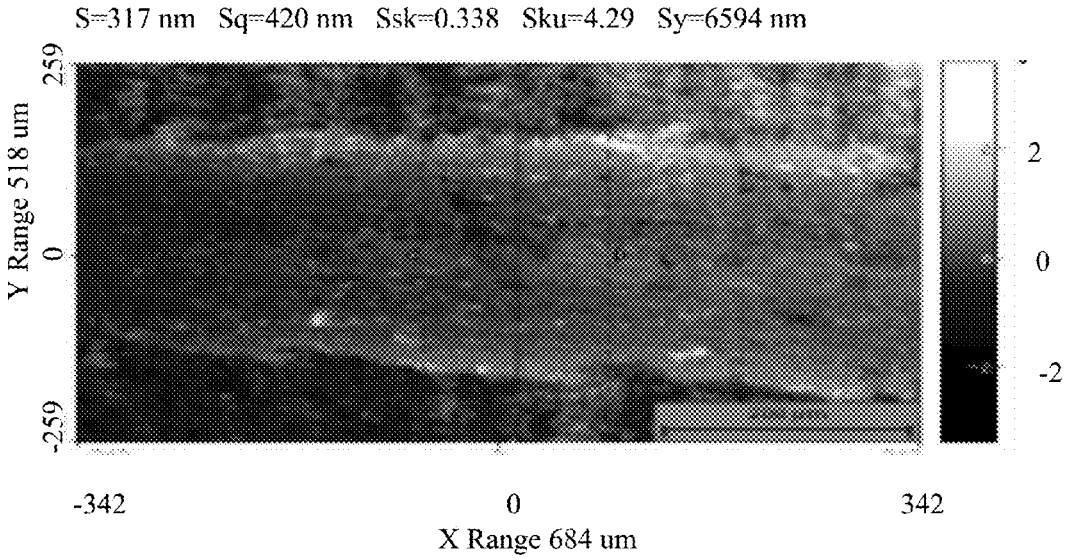
Figure 13C:
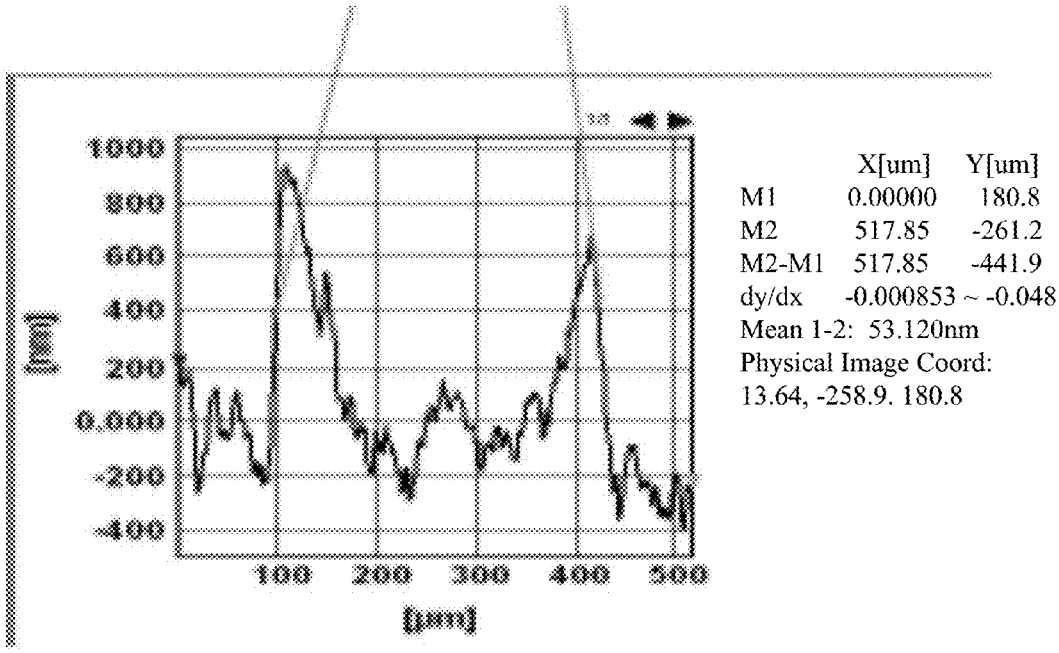
Figure 13D:
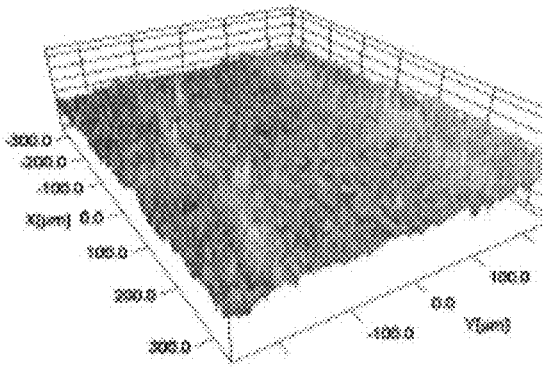

In yet another embodiment of the invention a WC—Co6% alloy substrate was borided; and the X-ray scan of FIG. 9 show an outer layer of CoB and an inner layer of CoB+$WB_4$. The use of Co as a binder hinders formation of $WB_4$ as compared to Ni (see FIGS. 8(*a*) and 8(*b*)). The hardness values for W-6% Co were also 11-12 GPa versus 31-35 GPa for the Ni alloy of FIGS. 8(*a*) and 8(*b*). These can be compared to hardness values of diamond 115 GPa; C—BN; 48 GPa; $B_4C$; 30 GPa; and $OsB_2$ 37 CPa.

The following non-limiting Examples illustrate various aspects of the invention.

Example I

Wear testing was performed for a borided W—Re alloy against a ⅜" diameter wear ball of 52100 steel at room temperature, and ball rotation rate of 50 rpm at a load of 1N. As shown in FIGS. 10(*a*)-10(*c*), the wear surface shows no abrasion of the wear surface; and FIG. 10(*d*) shows coefficient of friction versus time for a 1 h test.

FIGS. 11(*a*)-11(*d*) confirm the layer depositions on the substrate and that virtually no wear occurred to the borided surface.

Example II

Wear testing was performed for a borided W—Re alloy against a ⅜" diameter alumina ball for the same operating conditions as Example I. As shown in FIGS. 12(*a*)-12(*c*) the wear surface shows no abrasion of the borided surface and FIG. 12(*d*) shows coefficient of friction versus time for the 1 h test. FIGS. 13(*a*)-13(*d*) show an SEM image of the surface of the borided W—Re surface after the test shown in FIGS. 12(*a*)-12(*c*). FIG. 13(*b*) shows a cross-section of the tested, borided W—Re surface; and FIG. 13(*c*) shows a profilometer scan of the cross-section of FIG. 13(*b*). FIG. 13(*d*) shows a profilometer 3D scan image from the scan of FIG. 13(*c*).

The foregoing description of embodiments of the present invention have been presented for purposes of illustration and description. It is not intended to be exhaustive or to limit the present invention to the precise form disclosed, and modifications and variations are possible in light of the above teachings or may be acquired from practice of the present invention. The embodiments were chosen and described in order to explain the principles of the present invention and its practical application to enable one skilled in the art to utilize the present invention in various embodiments, and with various modifications, as are suited to the particular use contemplated.

The invention claimed is:

1. A method of forming a boride material on a substrate, comprising the steps of, providing a boriding component;

providing a substrate having a metal alloy having a first metal constituent comprising tungsten (W) and a second metal constituent comprising rhenium (Re);

disposing the substrate and the boriding component in an electrochemical bath;

establishing the electrochemical bath at a temperature of about 900°-1050° C.; and forming a first metal constituent conforming boride layer comprising $WB_4$ on the substrate and a second metal constituent conforming boride layer comprising $ReB_2$ on the first metal constituent conforming boride layer.

2. The method of forming a boride material on a substrate of claim 1, wherein the metal alloy consists essentially of W—Re 25% alloy.

3. A method of forming a boride material on a substrate, comprising the steps of, providing a boriding component;

providing a substrate having a metal alloy having a first metal constituent comprising tungsten (W) and a second metal constituent comprising rhenium (Re), the metal alloy consisting essentially of W—Re 25% alloy;

disposing the substrate and the boriding component in an electrochemical bath;

establishing the electrochemical bath at a temperature of about 900°-1050° C.; and forming a first metal constituent conforming boride layer on the substrate and a second metal constituent conforming boride layer on the first metal constituent conforming boride layer.

4. The method of claim 3, wherein the first metal constituent conforming boride layer comprises $WB_4$ and the second metal constituent conforming boride layer comprises $ReB_2$.

* * * * *